United States Patent [19]

Dionne

[11] 3,991,479

[45] Nov. 16, 1976

[54] CLOTHES DRYER WITH ANTI-STATIC MAGNET

[76] Inventor: Michael Dionne, 2117 Lenore Drive, West Bend, Wis. 53095

[22] Filed: Nov. 7, 1975

[21] Appl. No.: 629,944

[52] U.S. Cl. ..... 34/1; 34/133; 317/2 R

[51] Int. Cl.[2] ..... F26B 3/34; F26B 11/02

[58] Field of Search ..... 34/1, 133, DIG. 3; 317/2 R

[56] References Cited

UNITED STATES PATENTS

| | | | |
|---|---|---|---|
| 1,701,156 | 2/1929 | Heritage | 34/1 |
| 2,568,068 | 9/1951 | Harpman | 317/2 R |
| 2,975,528 | 3/1961 | Shewmon | 34/13 |
| 3,161,479 | 12/1964 | Biderman | 34/1 |
| 3,320,479 | 5/1967 | Owens | 317/2 R |

*Primary Examiner*—John J. Camby

*Attorney, Agent, or Firm*—Arthur L. Morsell, Jr.

[57] ABSTRACT

A magnet is attached to an interior surface of a rotary clothes dryer in a manner to provide a magnetic field which is located within the interior of the dryer drum which induces electric currents in clothes which are tumbling in the dryer to neutralize static electric charges in the clothes.

6 Claims, 4 Drawing Figures

Fig. 1
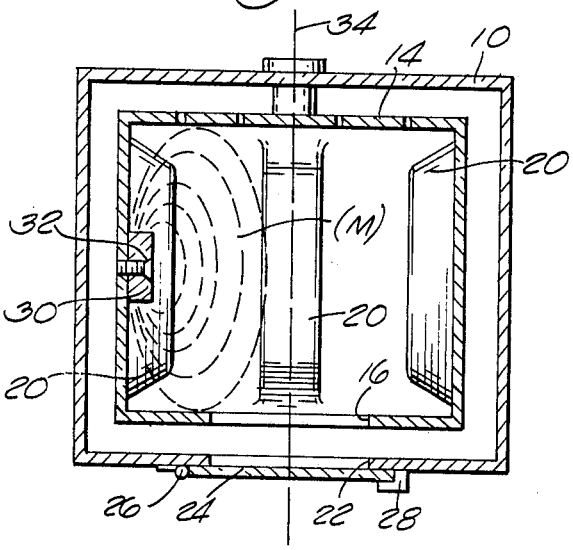
Fig. 2
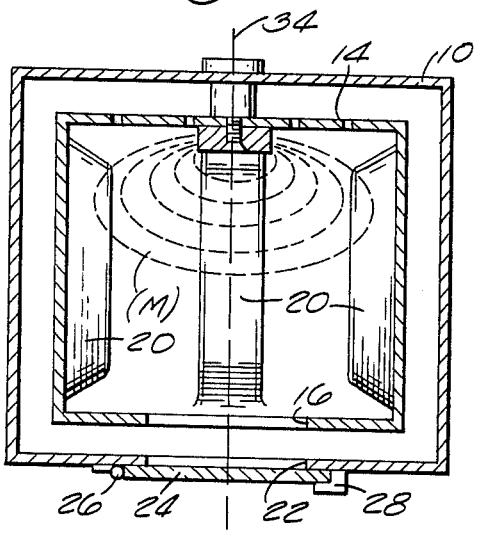
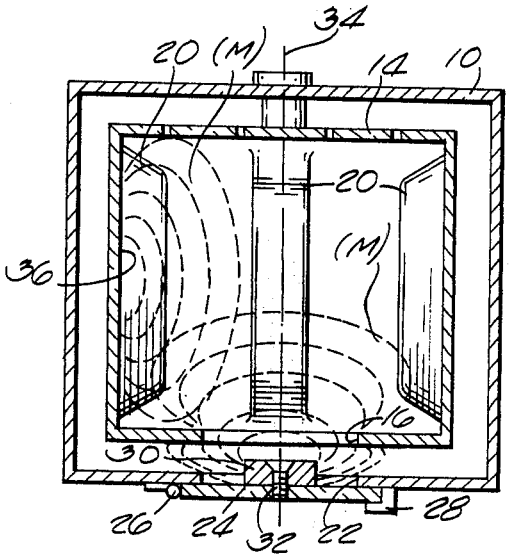
Fig. 3
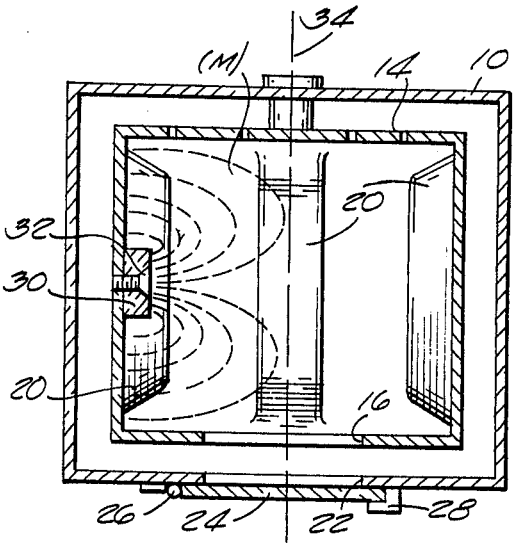
Fig. 4

CLOTHES DRYER WITH ANTI-STATIC MAGNET

BACKGROUND OF THE INVENTION

When clothes are dried in a rotary clothes dryer, the tumbling action of the clothes in the dryer drum causes enough friction between the clothes and the interior of the dryer drum to induce appreciable charges of static electricity in the clothes. The static charges cause the clothes to stick to each other when they are removed from the dryer. This makes it difficult to separate the clothes from each other for folding or ironing. In addition, the static charges may cause lint to stick to the clothes and require extensive brushing to remove the lint. The static charges are not known to be harmful to people, but they are troublesome, and it is highly desirable to provide a means of neutralizing the static charges before the clothes are removed from the dryer.

U.S. Pat. No. 2,568,068 discloses one type of prior art anti-static circuit which has been used to neutralize static electric charges on garments in rotary dry cleaning machines. Referring to FIG. 2 of U.S. Pat. No. 2,568,068, the dry cleaner includes a rotatable drum or basket 16 which is rotatably mounted within a housing 15. Housing 15 and drum 16 are both normally filled with dry cleaning fluid during the cleaning operation. The cleaning fluid can flow from the interior of drum 16 to the exterior thereof through perforations 17 therein. The anti-static circuit includes an elongated cylindrical grounding electrode 10 which is mechanically attached to an end of housing 15 and extends axially inwardly outside of drum 16. The static electric charges which collect on garments within a perforated rotary drum 16 are electrically communicated through the dry cleaning fluid and perforations 17 to grounding electrode 10 and thence through an electric conductor 18 to a ground connection 19. A permanent magnet 14 is mounted on the inner end of grounding electode 10 with its magnetic lines of force oriented so as to deflect electric currents in its neighborhood toward the grounding electrode 10 to enhance the anti-static current flow. Here the magnet is shielded by the metal of the rotor so that the magnetic field cannot enter the interior of the dryer. The magnet 14 does not neutralize the static electricity, but rather directs the flow of electrons in its neighborhood toward grounding electrode 10 which performs the neutralizing function.

The construction shown in U.S. Pat. No. 2,568,068 is suitable for use in dry cleaning machines but not in rotary clothes dryers because the latter are not filled with an electrically conductive fluid for transferring the electric charge from the interior of the rotating clothes drun to a stationary grounding electrode outside of the rotating drum.

U.S. Pat. No. 3,161,479 discloses an anti-static circuit which can be used in rotary clothes dryers. Referring to FIGS. 1 and 2 U.S. Pat. No. 3,161,479, this anti-static circuit includes a frictional belt drive unit 30 which operates on the well known Van de Graaff principle for generating a static charge. Frictional belt drive unit 30 is continuously driven by a V-belt drive 40 coupled to dryer motor M. The static charge is developed between a charge deposit brush 31 and a charge pick-up brush 32. Charge deposit brush 31 is grounded through conductor 24 and charge pick-up brush 32 is coupled through conductor 21 to an electrically conductive roller 51 which bears against the end of the rotating clothes dryer drum T. Roller 51 is spring loaded to maintain electrical contact with the periphery of drum T and conveys the electric charge from frictional drive belt unit 30 to drum T. As the clothes tumble, they contact the interior surface of drum T and thus pick up the electric charge therefrom to neutralize the static charge on the clothes. This does not use a magnetic field Although the above-described anti-static circuit is usable in rotary clothes dryers, it is relatively complex and costly and requires substantial modifications in the dryer's structure.

SUMMARY OF THE INVENTION

In accordance with this invention, it has been found that static charges on clothes in rotary clothes dryers can be neutralized in a very simple manner by providing a magnetic field in the interior of the dryer drum. As the clothes tumble in the dryer drum, they move through the magnetic field, and the resulting relative motion between the magnetic field and the molecules which make up the clothes causes currents to be induced therein which neutralize the static charges.

DESCRIPTION OF THE DRAWINGS

FIG. 1 is a top axial sectional view of a rotary clothes dryer having a permanent magnet attached to the interior wall of the dryer drum with the N-S axis of the magnet approximately parallel to the axis of the dryer drum.

FIG. 2 is a top axial sectional view of a rotary clothes dryer having a permanent magnet attached to the rear interior end of the dryer drum with the N-S axis of the magnet approximately perpendicular to the axis of the dryer drum.

FIG. 3 is a top axial sectional view of a rotary clothes dryer having a permanent magnet attached to the front interior end of the dryer drum opposite the clothes opening, with the N-S axis of the magnet approximately perpendicular to the axis of the dryer drum. FIG. 3 also discloses, as an alternative, the use of a part of the peripheral wall of the rotary drum as a permanent magnet for directing a magnetic field inwardly of the drum.

FIG. 4 is a top axial sectional view of a rotary clothes dryer having a permanent magnet attached to the interior wall of the dryer drum with the N-S axis of the magnet approximately perpendicular to the axis of the dryer drum.

DESCRIPTION OF THE PREFERRED EMBODIMENT

FIGS. 1 – 4 show alternate ways of mounting a permanent magnet within a rotary clothes dryer to provide a magnetic field within the dryer's clothes drum which is effective to eliminate static. The clothes dryer is represented schematically by a cubical housing 10 within which a conventional clothes dryer drum 12 is rotatably mounted by conventional means not shown. Drum 12 is generally cylindrical in shape, is closed at its rear end 14, and has an access opening 16 in its front end 18. A plurality of inwardly projecting vanes or flights 20 are provided within drum 12 to agitate or tumble the clothes within drum 12 when it is rotated. It will be understood that the clothes dryer also includes conventional electric motor means for rotating the drum 12, a conventional heater, and conventional means for blowing heated air into drum 12, although these means are not shown in the drawing. Drum 12 is usually made of enameled steel.

Housing 10 has an access opening 22 opposite the access opening 16 of drum 12. A door 24 is swingably attached on hinges 26 over access opening 22 and engages a releasable latch 28 which releasably holds door 24 closed.

The basic concept of this invention is to provide a magnetic field within the interior of dryer drum 12 so that clothes in drum 12 will move through the magnetic field as they tumble in drum 12 to induce electrical currents in the clothes. The law of electromagnetic induction states that relative motion between a magnetic field and an electrical conductor induces a voltage in the conductor which is directly proportional to the strength of the magnetic field and to the speed of the relative motion. This law holds for poor conductors as well as for good conductors, the only difference being in the magnitude of current flow involved. Therefore, as the clothes tumble through the magnetic field, voltages will be induced in the fabrics and this will produce corresponding current flow in the fabrics.

Static electrical charges consist of either a surplus or a deficiency of electrons in the molecules that make up the charged material. A surplus of electrons produces a negative charge and a deficiency of electrons produces a positive charge. A negative charge is neutralized by draining off the surplus electrons, while a positive charge is neutralized by adding enough electrons to the material to make up for the deficiency. The number of elecrons added or subtracted has to be equal to the excess or deficiency of electrons to avoid changing a positive static charge into a negative static charge or vice versa.

It is not known why the magnetically induced current flow in the clothes should be just the proper magnitude to neutralize the static charges which are induced by friction between the clothes and the drum, but it has been determined experimentally that this is true. In trial after trial, with various fabrics such as polyester knit, nylon tricot, banlon, 100% acrylic, cotton, rayon, and acrilon, a magnetic field inside the dryer drum has produced static free clothes. When the magntic field was removed, the static charges reappeared. The experimental evidence leaves no doubt that the magnetic field causes neutralization of the static charges in the clothes, although it is not clear why the magnetically induced currents should exactly balance out the frictionally induced static charges.

The magnetic field can be generated in the interior of the dryer drum 12 by a permanent magnet or by an electromagnet, although a permanent magnet is preferred since it is less expensive than an electromagnet and does not require any significant alterations in the dryer. The permanent magnet can be placed in any convenient position which allows its magnetic field (*m*) to extend within drum 12 in a position to interact with the tumbling clothes.

In FIG. 1, a small bar magnet 30 is attached by a screw 32 to the inside wall of rotary drum 12 between flights 20 with the N-S axis of magnet 30 approximatey parallel with the axis 34 of drum 12. The magnetic field produced by magnet 30 is indicated by the curved broken lines (*m*) emanating from magnet 30. It will be noted that only the inner half of the magnetic field is shown in FIG. 1. This is due to the fact that the outer half is distorted and absorbed by the steel wall of drum 12. However, this does not interfere with the action of the invention since only the inner portion of the magnetic field interacts with the tumbling clothes.

FIG. 2 shows another possible orientation of the magnetic field in which bar magnet 30 is attached to the rear end 14 of rotary dryer drum 12, with the N-S axis of magnet 30 approximately perpendicular to the axis 34 of drum 12. In FIG. 3, magnet 39 is attached to the inner side of dryer housing door 24 with its N-S axis approximately perpendicular to the axis 34 of rotary drum 12. Here the permanent magnet is opposite the opening 16 of the clothes opening of the drum so that the magnetic field can enter the interior of the drum. In FIG. 4, magnet 30 is attached in the same position as shown in FIG. 1 but with the N-S axis being approximately perpendicular to axis 34 rather than parallel to it. This results in a different configuration of magnetic field than is shown in FIG. 1.

The size and strength of magnet 30 must be such as to neutralize the static charges in the clothes, and the size and strength will depend on the capacity of the dryer. Experiments have shown that complete neutralization of static charges in a conventional household dryer can be effected with a small magnet measuring ¼ by ¼ × ¼ inch of the type used to hold messages on a metal note board. Larger magnets have also been successfully tried, including a bar magnet measuring 6 × ¾ by ¼ inch, a horseshoe magnet measuring 6 × 3-½ × ¾ inch, and a circular magnet measuring 2-½ inch in diameter and 162 inch thick.

In the course of the experiments, it was noted that after a magnet had been used in the dryer for several months, and was then removed, the static free condition of the clothes would continue for several weeks after removal of the magnet. This was attributed to the affect of the residual magnetization in the adjacent wall of dryer drum 12. While this residual magnetization persists, the static charges in the clothes are neutralized, but after the residual magnetization fades, the static charges return. Thus a separate permanent magnet is not necessary, as a permanent magnet may be formed by a part of the wall of the rotor 14 or housing door 24 as at 36, FIG. 3, which parts are both made of steel. This might be done during the manufacture of the clothes dryer and would eliminate the attached magnet 30 which, though small, provide some protrusion into the otherwise smooth interior of dryer drum 12.

What is claimed is:

1. In a rotary clothes dryer having a rotatable dryer drum in which clothes are tumbled while they dry, the improvement comprising means for producing a non-alternating magnetic field within said dryer drum which is free to act on said clothes through an unshielded space through which said clothes tumble to induce electrical currents in said clothes by electromagnetic induction, thereby neutralizing static electrical charges in said clothes.

2. The clothes dryer of claim 1 in which said means for producing a magnetic field comprises a magnet attached to a portion of said clothes dryer in a position where its magnetic field extends in unshielded relationship into the interior of said dryer drum to interact with said clothes.

3. The clothes dryer of claim 2 wherein said magnet is a permanent magnet.

4. The clothes dryer of claim 2 wherein said magnet is attached to an interior surface of said rotary dryer drum.

5. The clothes dryer of claim 2 wherein the drum has an access opening, wherein there is a housing with a door opposite said access opening, and wherein said magnet is attached to the inner surface of said door opposite said access opening in a position where its magnetic field extends into the dryer drum through said access opening to interact with said clothes.

6. The clothes dryer of claim 1 wherein said means for producing a magnetic field comprises a magnetized portion in a wall of said clothes dryer adjacent to the interior of said dryer drum in such location that a portion of the magnetic field of said magnetized wall portion extends in unshielded relationship into the interior of said dryer drum in a space through which said clothes tumble.

* * * * *

UNITED STATES PATENT AND TRADEMARK OFFICE

CERTIFICATE OF CORRECTION

PATENT NO. : 3,991,479

DATED : November 16, 1976

INVENTOR(S) : Michael Dionne

It is certified that error appears in the above-identified patent and that said Letters Patent are hereby corrected as shown below:

Column 4, line 27, "162 inch thick" should be ---7/8 inch thick---.

Signed and Sealed this

First Day of March 1977

[SEAL]

*Attest:*

RUTH C. MASON
*Attesting Officer*

C. MARSHALL DANN
*Commissioner of Patents and Trademarks*